US007655194B2

(12) United States Patent
Muter

(10) Patent No.: US 7,655,194 B2
(45) Date of Patent: Feb. 2, 2010

(54) CATALYST SUBSTRATE SUPPORT

(75) Inventor: John P. Muter, King (CA)

(73) Assignee: DCL International Inc. (CA)

( * ) Notice: Subject to any disclaimer, the term of this patent is extended or adjusted under 35 U.S.C. 154(b) by 265 days.

(21) Appl. No.: 11/037,811

(22) Filed: Jan. 18, 2005

(65) Prior Publication Data

US 2006/0160698 A1 Jul. 20, 2006

(51) Int. Cl.

| | |
|---|---|
| ***B01D 50/00*** | (2006.01) |
| ***B01D 53/34*** | (2006.01) |
| ***F01N 3/00*** | (2006.01) |
| ***F23J 11/00*** | (2006.01) |
| ***B32B 3/12*** | (2006.01) |

(52) U.S. Cl. ..... 422/177; 422/168; 422/180; 428/116

(58) Field of Classification Search ..... 422/177; 428/593

See application file for complete search history.

(56) References Cited

U.S. PATENT DOCUMENTS

| | | | | |
|---|---|---|---|---|
| 3,441,381 | A | 4/1969 | Keith et al. | 422/176 |
| 3,479,731 | A | 11/1969 | Mantel et al. | 228/182 |
| 3,948,611 | A | 4/1976 | Stawsky | |
| 4,032,310 | A | 6/1977 | Ignoffo | |
| 4,142,864 | A | 3/1979 | Rosynsky et al. | 422/179 |
| 4,143,117 | A | 3/1979 | Gaysert | 422/179 |
| 4,158,037 | A | 6/1979 | Aoyama | 422/179 |
| 4,161,509 | A | 7/1979 | Nowak | |
| 4,220,625 | A | 9/1980 | Toh et al. | 422/180 |
| 4,239,733 | A | 12/1980 | Foster et al. | 422/179 |
| 4,250,146 | A | 2/1981 | Bailey | |
| 4,273,681 | A | 6/1981 | Nonnenmann | 502/338 |
| 4,279,864 | A | 7/1981 | Nara et al. | |
| 4,348,360 | A * | 9/1982 | Chang et al. | 422/122 |
| 4,350,617 | A | 9/1982 | Retallick et al. | 502/439 |
| 4,362,700 | A | 12/1982 | Hayashi et al. | |

(Continued)

FOREIGN PATENT DOCUMENTS

| | | |
|---|---|---|
| EP | 0558064 | 9/1993 |

(Continued)

OTHER PUBLICATIONS

Decision of Boards of Appeal of the European Patent Office re: Application No. 90910891.2, Oct. 24, 2001 (41 pages).

*Primary Examiner*—Jennifer K Michener
*Assistant Examiner*—Matthew J Merkling
(74) *Attorney, Agent, or Firm*—Harness, Dickey & Pierce, P.L.C.

(57) ABSTRACT

A catalyst substrate support is provided for a corrugated foil honeycomb matrix defining a plurality of passages extending therethrough which are generally parallel to an axis. A peripheral mantle extends about an outer perimeter of the matrix and has inwardly extending flanges which extend across an outer periphery of the opposite end faces to cover outermost of the passages and restrict fluid flow between the peripheral mantle and the matrix. The outer perimeter of the matrix and the peripheral mantle may be spaced apart to define a gap for accommodating differential thermal expansions of the matrix and the peripheral mantle, the gap being smaller than a height of the inwardly extending flanges. Cross members secured to each of the opposite end faces of the matrix may transfer at least part of the gravitational load of the matrix to the mantle.

11 Claims, 3 Drawing Sheets

U.S. PATENT DOCUMENTS

| | | | | | |
|---|---|---|---|---|---|
| 4,381,590 | A | | 5/1983 | Nonnenmann et al. | 29/890 |
| 4,402,871 | A | | 9/1983 | Retallick | 156/157 |
| 4,433,064 | A | | 2/1984 | Pignon | 502/300 |
| 4,448,754 | A | | 5/1984 | Isogai et al. | |
| 4,504,294 | A | * | 3/1985 | Brighton | 55/502 |
| 4,519,120 | A | | 5/1985 | Nonnenmann et al. | 29/890 |
| 4,521,947 | A | | 6/1985 | Nonnenmann et al. | 29/890 |
| 4,576,800 | A | | 3/1986 | Retallick | 422/180 |
| 4,598,063 | A | | 7/1986 | Retallick | 502/439 |
| 4,647,435 | A | | 3/1987 | Nonnenmann | 422/180 |
| 4,665,051 | A | | 5/1987 | Nonnenmann | 502/439 |
| 4,673,553 | A | | 6/1987 | Retallick | 422/180 |
| 4,765,047 | A | | 8/1988 | Retallick | 29/890 |
| 4,793,136 | A | * | 12/1988 | Whittenberger | 60/299 |
| 4,795,615 | A | | 1/1989 | Cyron et al. | 422/179 |
| 4,824,011 | A | | 4/1989 | Maus et al. | 228/173.7 |
| 4,832,998 | A | | 5/1989 | Cyron | 428/116 |
| 4,847,966 | A | | 7/1989 | Kuchelmeister | 29/890 |
| 4,849,185 | A | | 7/1989 | Wittig | |
| 4,923,109 | A | | 5/1990 | Cyron | 228/181 |
| 4,946,822 | A | | 8/1990 | Swars | 502/439 |
| 5,055,274 | A | | 10/1991 | Abbott | 422/171 |
| 5,084,361 | A | | 1/1992 | Toyoda et al. | 428/593 |
| 5,118,476 | A | | 6/1992 | Dryer et al. | 422/179 |
| 5,130,100 | A | | 7/1992 | Serizawa | 422/180 |
| 5,169,604 | A | | 12/1992 | Crothers, Jr. | |
| 5,316,997 | A | | 5/1994 | Toyoda et al. | 502/314 |
| 5,323,608 | A | * | 6/1994 | Honma | 60/299 |
| 5,329,698 | A | | 7/1994 | Abbott | 29/890 |
| 5,336,472 | A | | 8/1994 | Toyoda et al. | 422/177 |
| 5,346,675 | A | * | 9/1994 | Usui et al. | 422/180 |
| D351,608 | S | | 10/1994 | Cox | |
| 5,395,600 | A | | 3/1995 | Cornelison | 422/18 |
| 5,408,828 | A | | 4/1995 | Kreucher et al. | 60/299 |
| 5,589,142 | A | | 12/1996 | Gribbon | |
| 5,620,666 | A | | 4/1997 | Usui | 422/171 |
| 5,656,245 | A | | 8/1997 | Fujisawa et al. | 422/179 |
| 5,746,986 | A | | 5/1998 | Pollock et al. | |
| 5,785,931 | A | | 7/1998 | Maus et al. | 422/180 |
| 5,791,044 | A | | 8/1998 | Whittenberger et al. | 29/890 |
| 5,820,835 | A | | 10/1998 | Sheller et al. | 422/180 |
| 5,829,250 | A | * | 11/1998 | Lane et al. | 60/301 |
| 5,857,140 | A | | 1/1999 | Foster | 422/179 |
| 6,017,498 | A | | 1/2000 | Harding | 422/179 |
| 6,060,173 | A | | 5/2000 | Retallick | 428/593 |
| 6,086,829 | A | | 7/2000 | Shea et al. | 422/179 |
| 6,217,832 | B1 | | 4/2001 | Betta et al. | 422/179 |
| 6,242,071 | B1 | | 6/2001 | Yamada et al. | 428/116 |
| 6,288,008 | B1 | | 9/2001 | Matsumoto | 502/439 |
| 6,667,013 | B1 | | 12/2003 | Nilsson | 422/180 |
| 6,673,466 | B2 | | 1/2004 | Bruck et al. | 428/593 |
| 2004/0031264 | A1 | | 2/2004 | Jojima | 60/311 |
| 2004/0213708 | A1 | | 10/2004 | Wagner et al. | 422/180 |
| 2005/0284115 | A1 | | 12/2005 | Hung | |
| 2006/0105139 | A1 | * | 5/2006 | Suwabe et al. | 428/116 |
| 2006/0159597 | A1 | | 7/2006 | Muter et al. | |

FOREIGN PATENT DOCUMENTS

| | | |
|---|---|---|
| EP | 0643204 | 9/1993 |
| GB | 937466 | 5/1961 |
| GB | 937466 | 9/1963 |
| GB | 1452982 | 10/1976 |
| WO | WO 03/106028 A1 * | 12/2003 |

* cited by examiner

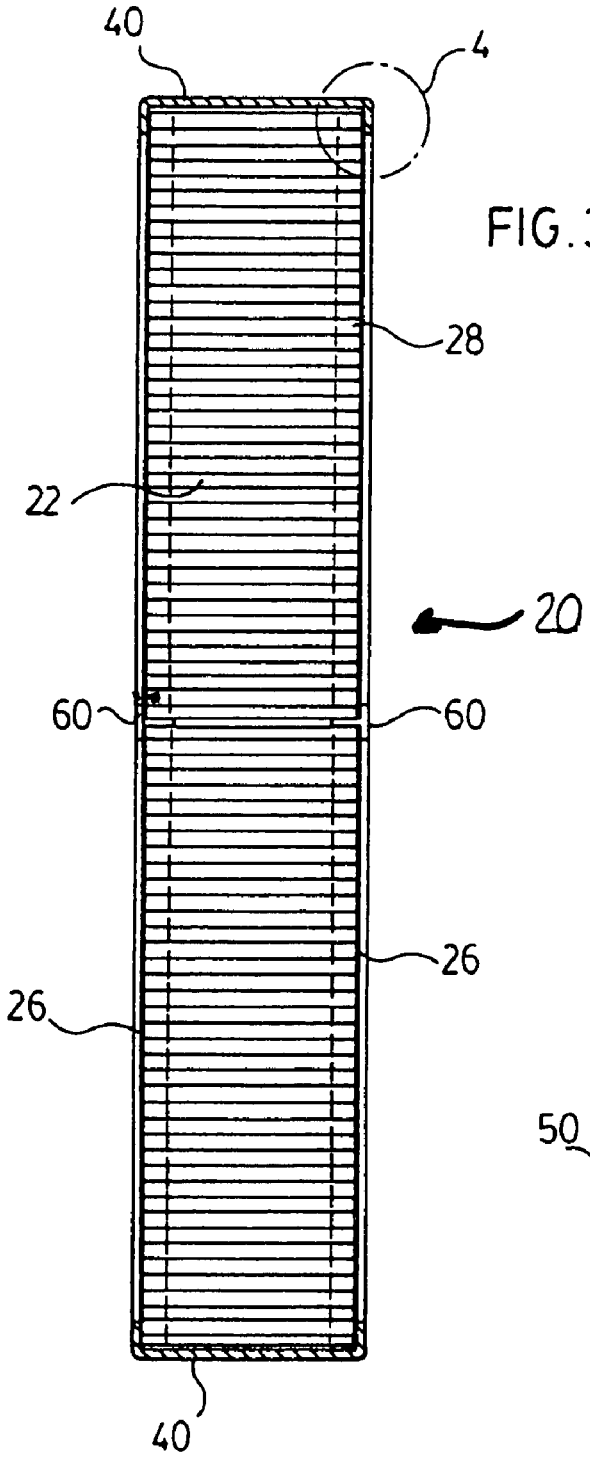
FIG. 3.
FIG. 4.
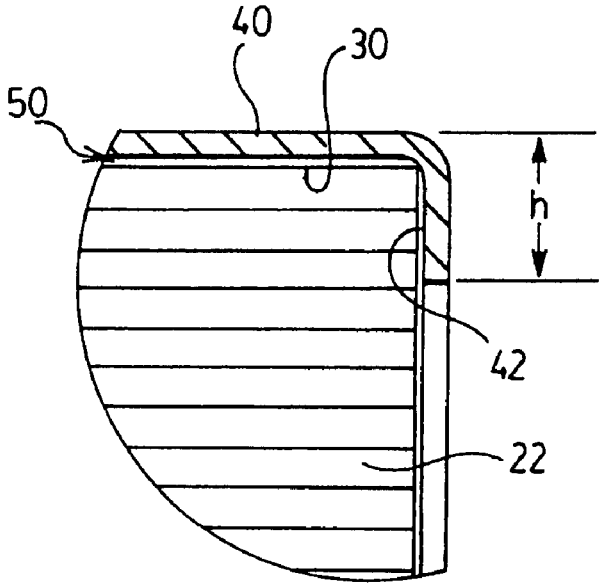

CATALYST SUBSTRATE SUPPORT

FIELD OF THE INVENTION

This invention relates generally to exhaust gas catalytic converters and more particularly to the support of a catalyst substrate in catalytic converters utilizing a corrugated foil matrix catalyst substrate.

BACKGROUND OF THE INVENTION

Honeycomb matrixes made from high temperature steel foil are used as support structures for catalytic coatings, for both automotive and industrial (stationary engine) applications. Industrial applications pose different challenges than automotive applications to the service life of the catalyst substrate. This is because of the significantly larger size of industrial type catalytic converters.

The matrix is usually formed by winding previously corrugated foil into a spiral shape to form a multitude of channels or passages. The foil is quite thin, typically on the order of a few thousands of an inch and accordingly relatively easy to bend. In the case of industrial sized units the diameter of the matrix may approach six feet (2.0 m).

The matrix has an axis about which the spiral winds. The passages run generally parallel to the axis. The matrix is mounted within a housing. Although the matrix may be mounted with its axis vertically aligned, in practise the matrix is generally mounted with its axis aligned horizontally with a bottom portion of the outer periphery of the matrix resting on an interior wall of the housing. The balance of the outer periphery is in close proximity to the interior wall to avoid gas leakage about the matrix.

In larger sized converters, failures due to collapse of the channels or passages arise. Contributing factors to the collapse may be the weight of the matrix and thermal stresses. Failure is believed to occur in stages. In a first stage some of the lowermost channels collapse causing the matrix to drop in the housing and enlarge the gap between the uppermost regions of the matrix and the corresponding portion of the interior wall of the housing. The enlarged gap in turn permits gas flow leakage between the housing and the matrix. The gas flow leakage in turn causes the matrix to flutter thereby incurring more damage until it becomes ineffective.

In very large reactors, the matrix is built up of arrays of smaller rectangular elements which are shrouded about the perimeter in order to retain the foil and provide a well-defined cross-section. In view of the relatively modest size, the individual elements are not designed with weight bearing or thermal expansion considerations in mind. The present invention is directed at large round cross-section matrixes (rather than built up matrixes) where weight in the past has been supported over a relatively small contact area by the lowermost foil layers. The expression "round section" is intended to reflect the most likely and common design choice rather than to impose a limitation that the cross-section must be circular rather than having another curved profile not perfectly circular.

Matrix life is also a function of how long the catalytic coating deposited thereon will last. This is generally however a function of the amount of coating applied. As the catalytic materials in the coating are very expensive (such as platinum) currently the amount of the coating applied is related to the expected service life of the support structure. If greater longevity were achievable in the support, longer service of the matrix would be achievable by applying more catalyst. While this would increase the cost of the converter it is believed that any such increase would be outweighed by costs associated with the downtime required to exchange the matrix within the converter or to exchange the entire converter.

It is an object of this invention to provide a catalyst substrate support arrangement which is less prone to collapsing than the prior arrangements. It is also an object of this invention to provide a catalyst substrate mounting arrangement which is more tolerant to radial collapse before the onset of leakage than prior designs.

SUMMARY OF THE INVENTION

In general terms, the present invention reduces creep stresses in the cellular structure of the catalyst substrate support by reducing gravitational stresses on the support and by accommodating thermal expansion of the cellular structure.

More specifically, a catalyst substrate support is provided which has a corrugated foil honeycomb matrix having an axis and defining a plurality of passages therethrough which are generally parallel to the axis and extend between opposite end faces of the matrix. A peripheral mantle extends about an outer perimeter of the matrix. The peripheral mantle has inwardly extending flanges which extend across an outer periphery of the opposite end faces to cover outermost of the passages and restrict fluid flow between the peripheral mantle and the matrix.

The outer perimeter of the matrix and the peripheral mantle may be spaced apart to define a gap for accommodating differential thermal expansions of the matrix and the peripheral mantle, the gap being smaller than a height of the inwardly extending flanges.

The catalyst substrate support may have at least one cross member extending across and secured to each of the opposite end faces of the matrix. The matrix may have recesses extending into the opposite end faces for receiving the cross members. The cross members support the matrix in the peripheral mantle to transfer at least part of the gravitational load of the matrix to the mantle.

The cross members may be slidingly received by the recesses in the matrix to avoid transfer of thermally induced stresses between the matrix and the peripheral mantle.

DESCRIPTION OF DRAWINGS

Preferred embodiments of the invention are described below with reference to the accompanying illustrations in which:

FIG. 3 is section on line 3-3 in FIG. 1;

FIG. 4 is an enlargement of the encircled area 4 in FIG. 3;

DESCRIPTION OF PREFERRED EMBODIMENTS

Figure 1:
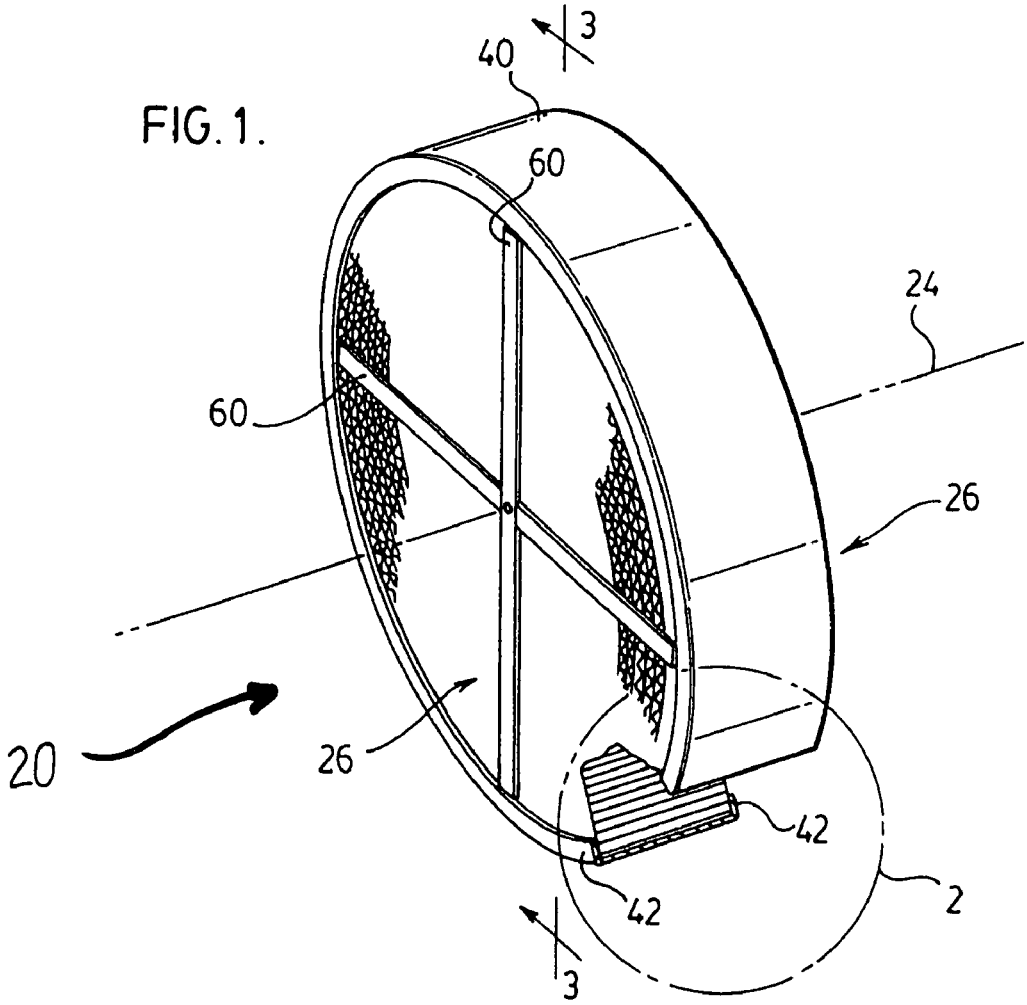
FIG. 1 is partially cutaway isometric view illustrating a catalyst substrate mounted in a catalyst substrate support according to the present invention.
Figure 2:
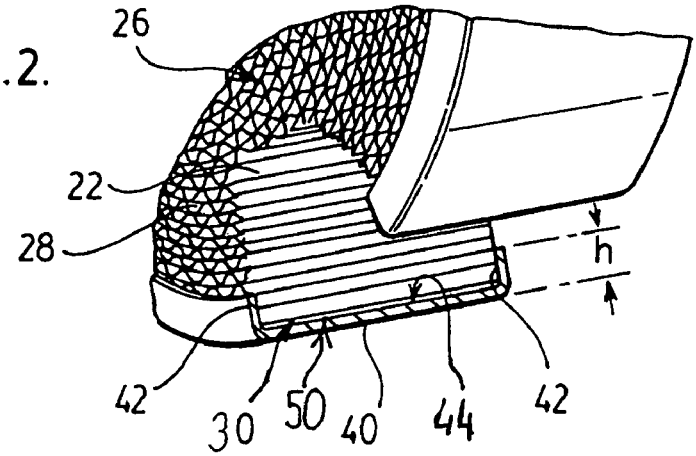
FIG. 2 is an enlargement of the encircled area 2 in FIG. 1.
Figure 5:
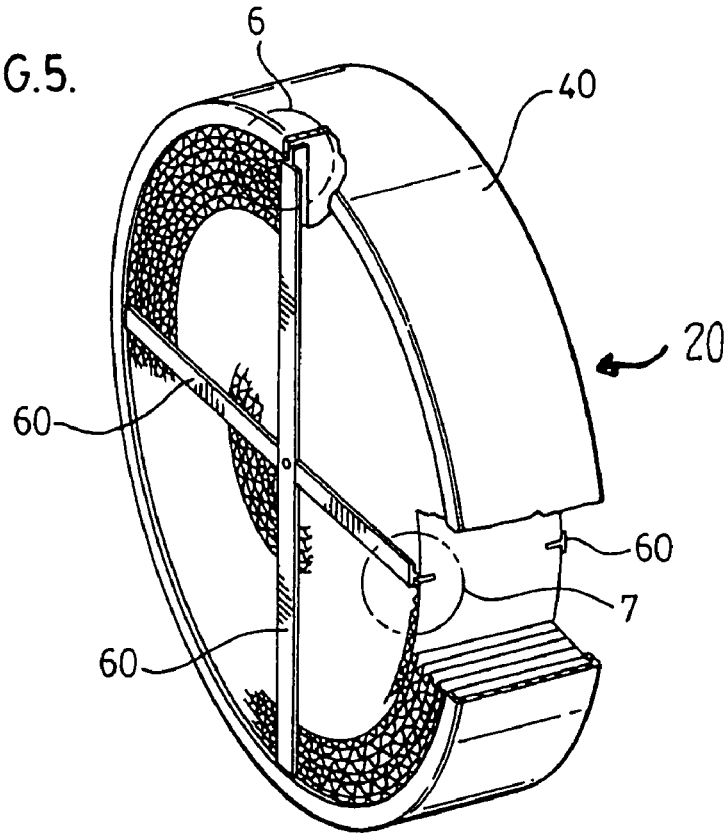
FIG. 5 is a partially cutaway isometric view corresponding to FIG. 1.

A catalyst substrate support according to the present invention is generally indicated by reference 20 in the accompanying illustrations. The catalyst substrate support has a corrugated foil honeycomb matrix 22 having an axis 24. The matrix 22 has opposite end faces 26. The matrix 22 defines passages 28 which extend between the opposite end faces 26 to allow fluid flow (typically gaseous) through the matrix 22. The passages 28 are generally parallel to the axis 24.

A parallel mantle 40 extends about an outer perimeter 30 of the matrix 22. The peripheral mantle 40 has a pair of inwardly extending flanges 42 which extend across the passages adjacent an outer periphery of the opposite end faces 26. In other words, the matrix 22 is nested in a channel of generally "U" shaped cross-section defined by the flanges 42 and an inner face 44 of the peripheral mantle 40.

The peripheral mantle 40 may be fabricated by rolling a suitably dimensioned channel and joining its ends. The flanges preferably have a height corresponding to the height of from 3 to 10 of the passages 28.

The flanges 42 seal off the adjacent passages 28. The seal need not be perfect as the object is to substantially avoid fluid flow between the matrix 22 and the peripheral mantle 40. As the matrix 22 has relatively low resistance to fluid flow, close proximity of the outer perimeter of the opposite end faces to the flanges 42 are all that is required as this will present significantly greater fluid flow resistance in this region encouraging fluid flow through the matrix 22 instead.

The flanges are intended to accommodate collapse of some of the lowermost of the passages 28 in the matrix 22 without enabling gas leakage between the diametrically opposed portion of the outer perimeter 30 of the matrix 22 and the peripheral mantle 40. The gap 50 accommodates different rates of expansion and contraction of the peripheral mantle 40 and the matrix 22 to avoid stresses which would otherwise result.

During heat up of the catalytic substrate support 20, the rate of heating of the matrix 22 will generally exceed that of the peripheral mantle 40 because of the thinness and high surface area of the matrix 22 being subject to high velocity fluid flow. In contrast, the peripheral mantle is of heavier gauge construction and subject to substantially only conductive and radiant rather than convective heat transfer mechanisms. During cooling down the matrix 22 will lose heat faster (cool air flowing through the passages 20) than the peripheral mantle 40. Accordingly during heating the matrix 22 is likely to expand at a rate exceeding that of the peripheral mantle 40 whereas during cooling the matrix will contract at a rate exceeding that of the peripheral mantle 40.

Allowing the gap 50 to exist between the peripheral mantle 40 and the matrix 22 alleviates thermally induced stresses therebetween but on its own doesn't mitigate stresses arising from the weight of the matrix 22 resting on its lowermost edge. Accordingly in order to reduce gravitational loading on the matrix 22, embedded supports 60 are provided which transfer gravitational forces on the matrix 22 to the peripheral mantle 40.

The supports 60 may be of "T" shaped cross-section as illustrated however other shapes, such as rectangular may be used. The supports 60 are received in recesses 62 which extend into the opposite end faces 26 of the matrix 22. Preferably the supports 60 are not rigidly affixed to the matrix such as by welding but rather slidingly engage the matrix 22 to allow relative movement therebetween. In such a manner relative differences in thermal expansion can be accommodated rather than causing stressing of the matrix 22 or the peripheral mantle 40.

Two supports 60 for each of the opposite end faces 26 are illustrated. Other configurations are possible, as long as the configuration transfers some of the weight of the matrix 22 to the peripheral mantle 40. For example, a "Y" shaped member or a single horizontally extending member may be utilized.

The supports 60 may be welded or otherwise fixedly attached to the peripheral mantle 40, particularly if it is desired to reinforce the peripheral mantle 40. Alternatively, the supports 60 may be secured to the peripheral mantle 60 in a manner that permits some relative expansion and contraction therebetween to be accommodated. For example, one end of the supports 60 may be slotted and affixed by a bolt or rivet to take up gravitational loading without transferring longitudinal loading.

Figure 6:
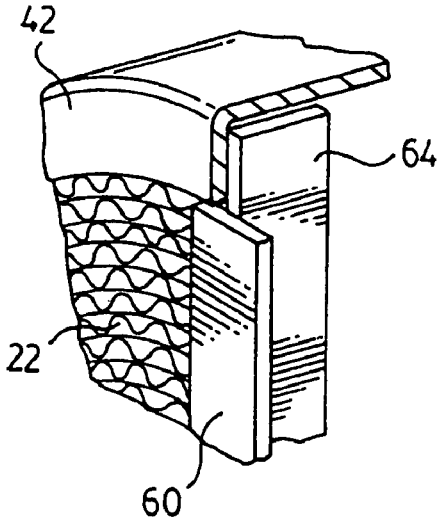
FIG. 6 is an enlargement of the encircled area 6 in FIG. 5.
Figure 7:
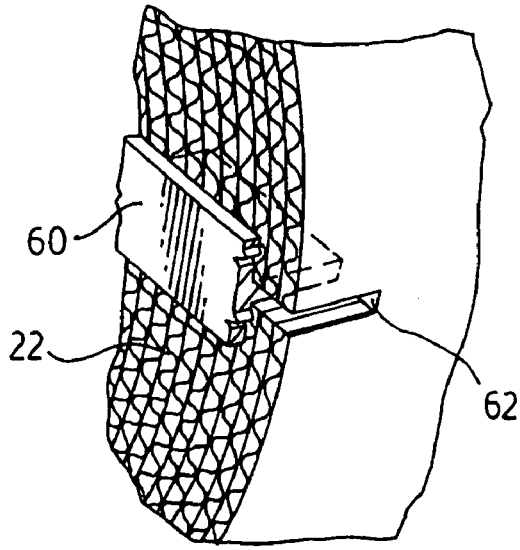
FIG. 7 is an enlargement of the encircled area 7 in FIG. 5.

More preferably as illustrated in FIG. 6, an embedded portion 64 of the supports 60 may extend under the flanges 42 into the channel defined by the flanged mantle 40. This may be accomplished by forming the flanged mantle 40 about the matrix and supports 60 after the supports 60 have been embedded in the matrix 22. Once installed, the combination of the matrix 22 and the peripheral mantle 40 will hold the supports 60 in place. This enables relative movement between the supports 60 and the peripheral mantle 40 as a result of differential thermal expansion to avoid buckling of the supports 60 during heating and cooling. While some buckling of the embedded portion 64 may be acceptable, such is undesirable with the non-embedded portion as any buckling out of the planes defined by the opposite end faces 26 of the matrix 22 could cause interference with the housing and is therefore to be avoided.

An advantage to the T-shape arrangement is that the non-embedded portion acts to stiffen the embedded portion 64. It also provides a surface area for the matrix to bear upon reducing the pressure cause by flow and gravitational axial forces. Additionally, the non-embedded portion provides a sliding contact surface during installation to avoid damage to the relatively soft matrix 22.

The above description is intended in an illustrative rather than a restrictive sense. Accordingly, the scope of the invention should not be restricted to the specific embodiments described as variants may be apparent to persons skilled in such structures without departing from the spirit and the scope of the invention as defined by the claims which are set out below.

PARTS LIST

Catalyst substrate support 20
Matrix 22
Axis (of matrix) 24
Opposite end faces 26
Passages 28
Outer perimeter 30 (of matrix)
Peripheral mantle 40
Inwardly extending flanges 42
Height (of flanges) h
Gap 50 (mantle to matrix)
Supports 60
Recesses 62
Embedded portion of supports 64

The invention claimed is:

1. A catalyst substrate support comprising:

a continuous spirally wound rounded cross-section corrugated foil honeycomb matrix having an axis and defining a plurality of passages therethrough which are generally parallel to said axis and extend between opposite end faces of said matrix, the matrix having an outer diameter;

a peripheral mantle extending about an outer perimeter of said matrix, said peripheral mantle having inwardly extending flanges which extend across an outer periphery of said opposite end faces to cover outermost of said passages and restrict fluid flow between said peripheral mantle and said matrix, the peripheral mantle having an inner wall defining an inner diameter of the mantle;

wherein the outer diameter of the matrix is less than the inner diameter of the peripheral mantle to leave a circumferentially extending void therebetween extending between the end faces of the matrix to accommodate different thermal expansions of said matrix and said peripheral mantle;

at least one cross member extending across an end face of the matrix;

said matrix having a slot in said end face extending substantially across said end face; and said cross member having a first portion that is received in the slot while allowing the cross member to slide relative to the matrix.

2. The catalyst substrate support of claim 1 wherein the void defines a gap with a height smaller than a height of said inwardly extending flanges.

3. The catalyst substrate support of claim 1 wherein the cross member is substantially T shaped; and wherein a leg of the T shaped cross member is received into the slot.

4. The catalyst substrate support of claim 1 wherein said cross member comprises a strip resting on an end face of the matrix, with said leg portion extending perpendicularly from the strip; and said strip having end portion located within the flanges of the mantle.

5. The catalyst substrate support of claim 4 further comprising two cross members, a first cross member extending horizontally across the matrix, and a second cross member extending vertically across the matrix, the first and second cross members being secured at an intersection thereof.

6. The catalyst substrate support of claim 2 wherein the flanges radially extend inwardly and have a height corresponding to from three to ten of the passages in the matrix.

7. A catalyst substrate support comprising:

a continuous spirally wound rounded cross-section corrugated foil honeycomb matrix, said matrix having a plurality of passages therein which are generally parallel to the axis, said matrix having opposite end faces and an outer perimeter;

a mantle extending about the perimeter of the matrix, said mantle having radially inwardly extending flanges that capture the matrix therein;

at least one cross-member extending across an end face of the matrix and spaced from the mantle;

said matrix having a slot in said end face extending substantially across said end face; and said cross-member having a first portion that is received in the slot while allowing the cross-member to slide relative to the matrix.

8. The catalyst substrate support of claim 7 wherein the cross member is substantially T shaped; and wherein a leg of the T shaped cross member is received into the slot.

9. The catalyst substrate support of claim 8 wherein said cross member comprises a strip resting on an end face of the matrix, with said leg portion extending perpendicularly from the strip; and said strip having an end portion located within the flanges of the mantle.

10. The catalyst substrate support of claim 9 further comprising two cross members, a first cross member extending horizontally across the matrix, and a second cross member extending vertically across the matrix, the first and second cross members being secured at an intersection thereof.

11. The catalyst substrate support of claim 7 wherein the flanges have a height corresponding to from three to ten of the passages in the matrix.

* * * * *

UNITED STATES PATENT AND TRADEMARK OFFICE

CERTIFICATE OF CORRECTION

PATENT NO. : 7,655,194 B2
APPLICATION NO. : 11/037811
DATED : February 2, 2010
INVENTOR(S) : John P. Muter It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 390 days.

Signed and Sealed this

Twenty-third Day of November, 2010

David J. Kappos

David J. Kappos
*Director of the United States Patent and Trademark Office*